United States Patent [19]

Eitel

[11] Patent Number: 4,721,213

[45] Date of Patent: Jan. 26, 1988

[54] EQUIPMENT AND METHOD FOR INSTALLING APPARATUS AT ELEVATED LOCATIONS

[76] Inventor: Jay M. Eitel, 130 Selby La., Atherton, Calif. 94025

[21] Appl. No.: 25,522

[22] Filed: Mar. 13, 1987

[51] Int. Cl.[4] ..... B66C 13/40

[52] U.S. Cl. ..... 212/160; 182/2; 414/680

[58] Field of Search ..... 212/159, 160, 270, 206; 182/2; 414/680

[56] References Cited

U.S. PATENT DOCUMENTS

| | | | |
|---|---|---|---|
| 2,261,483 | 11/1941 | Nickles | 182/2 |
| 3,675,786 | 7/1972 | Wilson | 212/206 |
| 3,690,408 | 9/1972 | Reske et al. | 182/2 |
| 3,891,264 | 6/1975 | Hunter et al. | 182/2 |
| 4,290,584 | 9/1981 | Eckels et al. | 182/2 |
| 4,582,206 | 4/1986 | Johnson | 182/2 |
| 4,606,469 | 8/1986 | Van Deijk | 182/2 |

*Primary Examiner*—Joseph F. Peters, Jr.
*Assistant Examiner*—Thomas J. Brahan
*Attorney, Agent, or Firm*—Flehr, Hohbach, Test, Albritton & Herbert

[57] ABSTRACT

Equipment for installing apparatus at an elevated location at a site comprising an aerial lift and a crane located at the site. Each of the aerial lift and the crane comprises a vehicle, a boom structure mounted on the vehicle and control means for the boom structure whereby the outer extremity of each of the boom structures can be rotated about a vertical axis raised and lowered about a horizontal axis and moved toward and away from the vehicle. At least one of the boom structures has a workman's bucket carried thereby. The other of the boom structures has the capability of lifting apparatus to an elevated location. The workman's bucket carries controls for operating each of the boom structures whereby a single workman on a workman's bucket can control the operation of both boom structures thereby permitting the workman to position himself in close proximity to the work to be performed and also permitting the workman to readily observe the lifting and positioning of the apparatus carried by the other boom structure as the work is to be performed with respect to the apparatus.

10 Claims, 2 Drawing Figures

EQUIPMENT AND METHOD FOR INSTALLING APPARATUS AT ELEVATED LOCATIONS

This invention relates to equipment and a method for installing apparatus at elevated locations.

Aerial bucket trucks or aerial lifts have been utilized extensively by utility companies and, in particular, by power companies for all types of aerial maintenance, as well as new construction.

Working on energized aerial power lines with aerial lifts requires that the boom structures of aerial lifts by fully insulated. The boom structures and buckets are constructed from fiberglass. The controls are generally hydraulic valves located in the bucket and at the base and are interconnected by synthetic hoses. Power companies have recognized many applications for this type of equipment and have encouraged manufacturers to strengthen the boom structures and to install two buckets with dual controls on the boom structures. Material handling equipment has been designed for boom structures to lift transformers and conductor lifting devices in order to make possible the changing of insulators and/or cross arms. The more recent models have increased lifting capacity which require extremely large vehicles to transport the boom and crew to the job site but must still have massive outriggers which are required to stabilize the vehicle. The cost of such machines is very high, particularly when incorporating two buckets, one on each side of the boom structures. The use of two buckets limits the ability to position the workman where needed.

For this reason some power companies have found it to be more efficient to use bucket trucks with each bucket truck having only one bucket per boom to provide greater flexibility and safety. It is often difficult to position a very large material handling boom structure and a bucket truck near the base of the power pole and then positioning the buckets in the desired work area. When lifting heavy materials with a bucket truck there is limited ability to maneuver the material into position and still have the workman in a safe working position. Regardless of the means used for supporting more than one man in and around energized conductors, it is a very hazardous operation at best since it is always possible for the workman to accidentally cross phases.

Because most aerial power lines were designed long before aerial lifts or bucket trucks were developed, they were designed to be maintained or repaired by one or more men climbing the poles and working with insulated gloves or hot sticks. The introduction of the bucket trucks has not materially changed these systems, but has eliminated the need of climbing the poles with the associated power tools. Insulated cranes have been used infrequently because all cranes are operated from the base and therefore the operator is unable to visually see with precision how or where to move the material for the man working from the bucket truck. There is therefore a need for a new and improved equipment and method which overcomes these disadvantages.

In general, it is an object of the present invention to provide equipment and a method for installing apparatus at elevated locations which greatly reduces the hazards encountered with such work.

Another object of the invention is to provide equipment and method of the above character which makes use of at least one aerial lift and one crane in which both are controlled by a single operator.

Another object of the invention is to provide equipment and method of the above character in which a single operator is positioned in a bucket or platform carried by the aerial lift.

Another object of the invention is to provide equipment and method of the above character which is particularly adapted for working around utility poles.

Another object of the invention is to provide equipment and method of the above character which permits the use of a lighter weight aerial lift.

Another object of the invention is to provide equipment and method in which the operator is in close proximity to the work being performed.

Another object of the invention is to provide equipment and method of the above character in which access to the work to be performed by the workman is improved without a jib being in the way.

Another object of the invention is to provide equipment and method of the above character in which the work area is enhanced enabling the workman to get closer to the pole.

Additional objects and features of the invention will appear from the following description in which the preferred embodiments are set forth in detail in conjunction with the accompanying drawings.

Figures 1, 2:
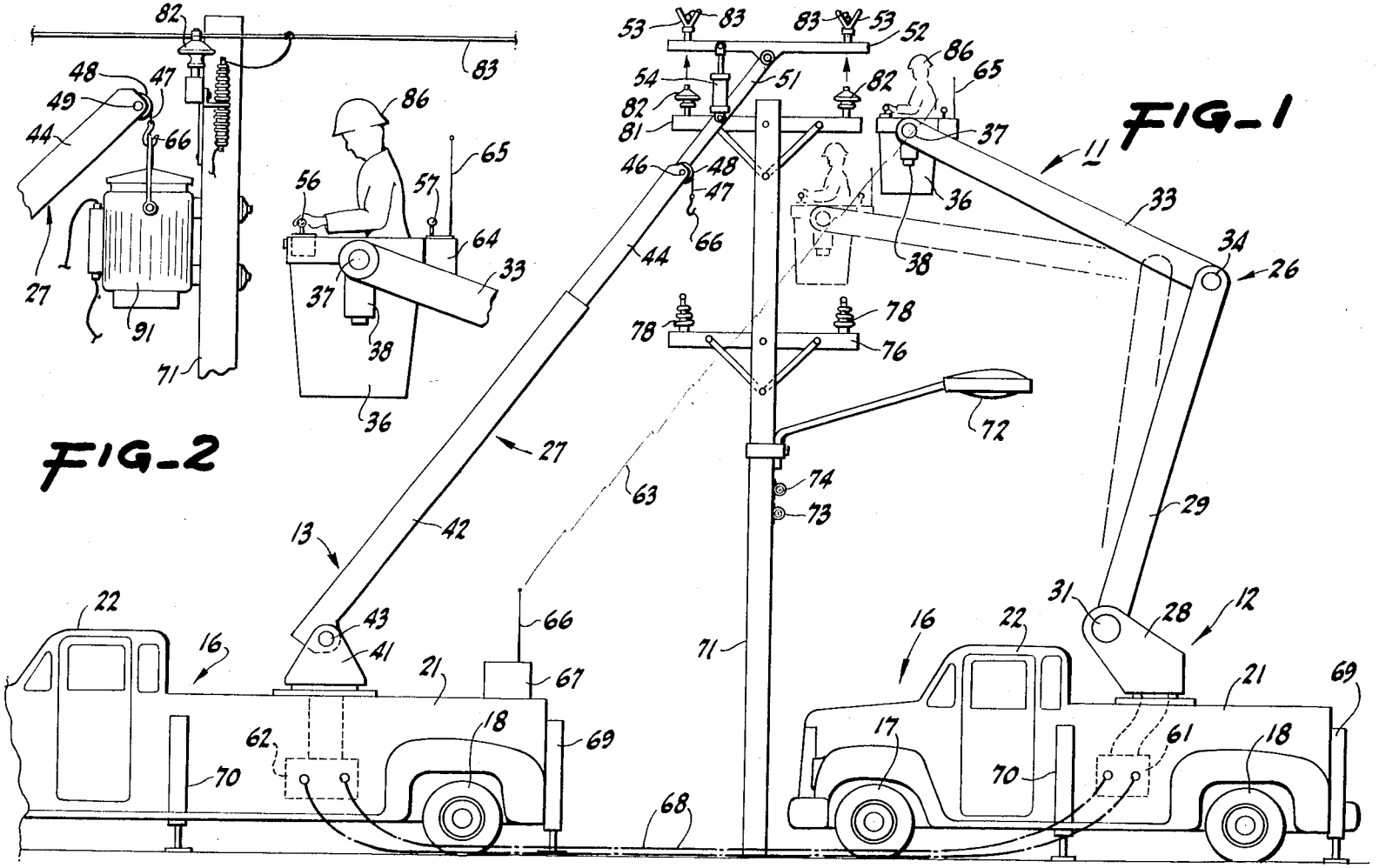
FIG. 1 is a side elevational view of equipment incorporating the present invention and showing the method used in conjunction therewith for installing apparatus at an elevated location and in particular for installing transformers, insulators and conductors on a pole.
FIG. 2 is a side elevational view showing the upper extremity of a workman's bucket or platform carried by an aerial lift and the upper extremity of the material handling crane being utilized to raise a transformer to a pole and showing the improvement in workman visibility.

In general the equipment for installing apparatus at an elevated location at a site is comprised of an aerial lift and a material handling crane located at the site. The aerial lift and the crane both include a vehicle with a boom mounted thereon and control means for the boom whereby the outer extremity of the boom can be rotated about a vertical axis, raised and lowered about a horizontal axis and moved toward and away from the vehicle. The boom of the aerial lift has a workman's platform bucket carried thereby. The other of the booms is provided with means for lifting apparatus to an elevated location at the site. Control means is accessible to the workman's platform or bucket for operating the control means for each of the booms whereby a single workman on the workman's platform or bucket can control the operation of both booms thereby permitting the workman to position himself and the apparatus to be positioned so that they are both at substantially the same location as work is being performed at the elevated location.

More, in particular as shown in the drawings, the equipment 11 for installing apparatus at an elevated location at a site is shown in FIG. 1 and consists of a mobile aerial lift 12 and a mobile crane 13. The aerial lift 12 and the crane 13 include a mobile self-propelled vehicle 16 which includes front and rear wheels 17 and 18 rotatably mounted upon a chassis or framework (not shown). Suitable motive means (not shown) is provided for supplying power to the rear wheels 18. Each vehicle is provided with a body 21 which is mounted upon the chassis and includes a operator's cab 22 from which the vehicle can be operated.

A boom structure 26 is mounted on the aerial lift 12 whereas a boom structure 27 is mounted on the crane lift 13. In many applications such as where power lines may be encountered, it is desirable the boom structures be electrically insulated from the vehicle. The boom structure 26 is of the articulated or elbow type and is comprised of a support structure 28 which is mounted upon the framework or chassis for rotation about a vertical axis. A lower boom or arm 29 is pivotally mounted on a pin 31 carried by the support framework 28 for rotation about a substantially horizontal axis. An upper arm or boom 33 has its innermost extremity pivotally connected by a pin 34 to the upper extremity of the arm or lower boom 29 to also permit swinging movement about a horizontal axis. A workman's platform or bucket 36 is mounted on the outer extremity of the arm or upper boom 33 and is pivotally mounted on the outer end of the upper boom 33 by pins 37. Pivotal movement of the basket or platform 36 is damped by a hydraulic damp mechanism 38.

The type of construction described for the articulated or elbow-type boom 26 is conventional. The same is true with respect to the boom structure 27 which is of a telescoping type. The articulated type of boom structure also can be used. The boom structure 27 is comprised of a support framework 41 which is rotatably mounted upon the framework or chassis of the vehicle 16 for rotational movement about a vertical axis. The boom structure 27 also includes a lower or outer boom 42 which has its lower extremity pivotally mounted on a pin 43 carried by the support framework for rotation about a horizontal axis. An upper or inner telescoping boom 44 is slidably mounted in the lower or outer boom 42 for telescoping movement in connection therewith.

Means is provided which is carried by the outer extremity of the upper or inner boom 44 for lifting apparatus and consists of a hook 66 carried by a rope 47 formed of an insulating material traveling over a sheave 48 rotatably mounted on a pin 49 on the outer end of the inner or upper boom 44. The rope 47 may travel through the telescoping booms internally or externally 42 and 44 and is wound upon rotatable drum (not shown) for letting out and retracting the rope 47 during hoisting operations. If desired, an additional jib 51 can be mounted on the outer extremity of the boom 44. The job 51, by way of example, can carry a cross arm 52 which carries Y-shaped members 53 which are adapted to receive conductors for utility applications. A hydraulically operated stabilizer 54 is provided for maintaining the cross arm 52 in a horizontal position as the boom structure 27 is raised and lowered.

The equipment 11 is also provided with control means accessible to the workman on the workman's platform or bucket for controlling the operation of both of the boom structures 26 and 27. This control means can consist of first and second control mechanisms 56 and 57 which are positioned adjacent to the workman on the workman's platform, as for example, on the upper extremity of the workman's bucket or platform 36 as shown in FIG. 1 of the drawings. These control mechanisms 56 and 57 can be of a conventional hydraulic type such as disclosed in U.S. Pat. Nos. 3,056,867 or 4,044,856, but preferably utilize a joy stick to facilitate operation of the same. Alternative radio operated fiber optic controls can be provided if desired. Each of the booms 26 and 27 includes conventional control means 61 and 62 for controlling the operation of each of the respective boom structures. These control means 61 and 62 provide controls whereby the outer extremity of the boom can be rotated about a vertical axis raised and lowered with respect to a horizontal axis and extended and retracted with respect to the vehicle. The control mechanisms 56 and 57 are coupled to the control means 61 and 62 in a suitable manner. For example, the control mechanism 56 can be coupled directly to the control means 61 of the aerial lift 12. The control mechanism 57 for the other control means 62 on the crane 13 can be controlled through a communication link 63 which establishes communication between the control mechanism 56 and the control means 52 and the crane 13. This communication link 63 can take the form of a radio link as shown in FIG. 1 in which the control mechanism 56 operates a battery powered transmitter 64 carried in the workman's bucket 36. The antenna 65 supplies control information to the antenna 66 of a receiver 67 mounted on the aerial lift 13. Other than such a radio link, the control means 61 can be comprised of fiber optics, hydraulic or the like. Also if desired, in place of the radio communication for the communication link 64, hydraulic hoses or fiber optic cables 68 can be provided as an alternative in which the cabling 68 interconnects the aerial lift 12 and the crane 13 as shown by broken lines in FIG. 1.

The details of the control mechanism 46 and 47, the control means 61 and 62, as well as the communication link 64 and the antenna 66 and receiver 67 are of a type well known to those skilled in the art and thus will not be described in detail.

In order to stabilize the aerial lifts during operation of the booms 26 and 27, outriggers of various types can be secured to the chassis. Thus, as shown, a pair of outriggers 69 are provided on opposite sides of the vehicle 16 at the rear extremity of the vehicle and similarly a pair of outriggers 70 are provided on opposite sides of the vehicle 16 adjacent the rear of the cab 22.

Operation and use of the equipment for installing apparatus at an elevated location at a site and the method of the present invention may now be briefly described as follows. Let it be assumed that the site at which work is to be performed is one which has a utility pole 71 such as shown in FIG. 1, which typically can be one which has numerous types of utilities already mounted on the pole and that it is desired to change the primary distribution system by changing the transformers and changing the insulators to increase the voltage used on the conductors. Such a utility pole 71 typically can carry street lighting 72 as well as telephone cables 73 and 74 mounted at various elevations on the pole. At another elevation and generally at a higher elevation, a cross arm 76 is provided which is utilized for carrying secondary power distribution conductors mounted upon insulators 78 carried by the cross arm 76. At a still higher elevation an additional cross arm 81 is provided which carries insulators 72 which are adapted to carry primary conductors 83 of a primary distribution system.

Let it be assumed that work is to be performed at the utility pole 71 which is of the character hereinbefore described. The aerial lift 12 and the crane 13 can be driven to the site by two workman and generally positioned in the manner shown in FIG. 1 in the vicinity of the pole 71. After the vehicles have been properly positioned, the outriggers 69 and 70 can be operated to provide adequate stabilization for the vehicles and the subsequent operations to be performed by the aerial lift 12 and the crane 13.

Let it also be assumed that a primary and secondary distribution system is in place and it is desired to increase the voltage on the primary system which requires replacement of the transformers and the insulators 82. Also let it be assumed that a workman 86 has entered the bucket 36 in a suitable manner such as by operating controls from the ground level to bring the bucket down to ground level at which time the workman can climb into the bucket. The workman can then utilize the controls 56 in the bucket to operate the same to position the bucket 36 in a desired position to perform the desired work.

The other workman brings a cross arm 52 to the crane 13 and attaches it to the jib 51. The workman in the bucket then causes operation of the crane to raise the cross arm into a position so that it underlies the conductors 83 carried by the insulators 82. The workman in the workman's bucket then positions himself so he is adjacent the insulators 82 and removes the preform ties. As soon as the preform ties have been removed, the crane 13 can be operated to raise the conductors off of the insulators. The insulators 82 can then be removed and new insulators of a higher voltage can be inserted onto the existing cross arm 81. The preform ties can then be replaced securing the conductors to the insulators. For the next segment of work the bucket operator or workman will elevate and reposition the crane 13 and attach the winch rope or sling 92 carried by the crane to the trnasformer to support the transformer. The bucket operator then positions himself to remove the attachment nuts and bolts. The operator then operates the crane to lower the transformer to the bed of the crane always repositioning his bucket to give the operator optimum control and safety. The groundman then attaches the new transformer 91 to the crane 13.

It can be seen that the workman at all times can position himself in the bucket so that he is in a position to view the operations taking place. In this way it is possible for the workman to work in close proximity to the work to be performed and at generally the same elevation so that his depth of perception is proper.

The boom structure 27 of the crane 13 can be operated to move its outer extremity down to the ground level at which point in time, the jib 51 with the cross arm 52 can be removed by the workman on the ground.

As soon as this has been accomplished, the operator 86 in the workman's bucket can operate the controls 56 and 57 to raise the transformer 91 to the desired location and at the same time to raise himself as the transformer is being raised so that he is at substantially the same elevation as the transformer and particularly so at the time the transformer reaches the desired elevation at the pole 71 as shown in FIG. 2. In this position, the workman is positioned to precisely ascertain the position on the transformer and to precisely locate the same by operating the boom structure 27 of the crane 13. As soon as the transformer has been raised to the desired location, the workman can perform the desired operations to mount the transformer on the pole. For example, he can use a power drill and other power tools to relocate bolts and tighten nuts from optimum and safe working positions. After the transformer has been mounted on the pole, the sling 92 can be removed and detached from the hook 46.

The outer end of the boom structure 27 of the crane 13 can then be moved to an out-of-the-way position so that it is ready to perform the next lifting operation required. After all the necessary operations have been performed at the pole 71, the aerial lift 12 and the crane 13 can be moved to the next pole to perform the same operations.

From the foregoing it can be seen that work can be performed at elevated locations requiring a minimum of manpower with improved safety and with lower cost equipment.

What is claimed is:

1. In equipment for installing apparatus at an elevated location at a site, an aerial lift and a crane located at the site, each of the aerial lift and the crane comprising a vehicle, a boom structure mounted on the vehicle and control means for the boom structure whereby the outer extremity of each of the boom structures can be rotated about a vertical axis raised and lowered about a horizontal axis and moved toward and away from the vehicle, at least one of the boom structures having a workman's bucket carried thereby and the other of the boom structures having means carried thereby for lifting apparatus to an elevated location, means accessible to the workman on the workman's bucket for operating the control means of each of the boom structures whereby a single workman on a workman's bucket can control the operation of both boom structures thereby permitting the workman to position himself in close proximity to the work to be performed and also permitting the workman to readily observe the lifting and positioning of the apparatus carried by the other boom structure as the work is to be performed with respect to the apparatus.

2. Equipment as in claim 1 together with means for insulating the boom structure of the aerial lift from the vehicle.

3. Equipment as in claim 2 together with means for insulating the boom structure of the crane from the vehicle.

4. Equipment as in claim 1 wherein the vehicle of said aerial lift and said crane is a self-propelled vehicle.

5. Equipment as in claim 4 wherein said self-propelled vehicle is a wheeled vehicle.

6. Equipment as in claim 1 wherein the means accessible to the workman in the workman's basket for operating the control means for each of the booms includes first and second control mechanisms positioned adjacent the workman's bucket.

7. Equipment as in claim 6 wherein the control means includes means for establishing communication between the control mechanism in the workman's bucket and the control means for the crane.

8. Equipment as in claim 6 wherein the means establishing communication includes a radio link.

9. Equipment as in claim 6 wherein the means for establishing communication includes a hydraulic link.

10. Equipment as in claim 6 wherein the means for establishing communication includes fiber optic conductors interconnecting the control means of the two booms.

* * * * *